US009709298B2

(12) United States Patent
Shang et al.

(10) Patent No.: US 9,709,298 B2
(45) **Date of Patent: *Jul. 18, 2017**

(54) INDOOR AIR-CONDITIONER UNIT WITH AIR DEFLECTOR

(75) Inventors: Bin Shang, Guangdong (CN); Tangtang Gu, Guangdong (CN)

(73) Assignee: GREE ELECTRIC APPLIANCES, INC. OF ZHUHAI, Zhuhai, Guangdong (CN)

( * ) Notice: Subject to any disclaimer, the term of this patent is extended or adjusted under 35 U.S.C. 154(b) by 654 days.

This patent is subject to a terminal disclaimer.

(21) Appl. No.: 14/238,837

(22) PCT Filed: Aug. 13, 2012

(86) PCT No.: PCT/CN2012/080061

§ 371 (c)(1),
(2), (4) Date: Feb. 13, 2014

(87) PCT Pub. No.: WO2013/023570

PCT Pub. Date: Feb. 21, 2013

(65) Prior Publication Data

US 2014/0199936 A1 Jul. 17, 2014

(30) Foreign Application Priority Data

Aug. 16, 2011 (CN) ..... 2011 1 0233898

(51) Int. Cl.

| | |
|---|---|
| ***F24F 13/10*** | (2006.01) |
| ***F24F 1/00*** | (2011.01) |
| ***F24F 13/14*** | (2006.01) |

(52) U.S. Cl.

CPC ..... *F24F 13/10* (2013.01); *F24F 1/0011* (2013.01); *F24F 13/1426* (2013.01); *F24F 2013/1446* (2013.01)

(58) Field of Classification Search

CPC .... F24F 13/10; F24F 13/14; F24F 2013/1446; F24F 13/1426

USPC ..... 454/304

See application file for complete search history.

(56) References Cited

FOREIGN PATENT DOCUMENTS

| | | |
|---|---|---|
| CN | 1487252 | 4/2004 |
| CN | 101109545 | 1/2008 |
| CN | 201155825 | * 11/2008 |
| CN | 101755173 | 6/2010 |
| EP | 2226581 | 9/2010 |
| JP | 8-247491 | 9/1996 |

(Continued)

OTHER PUBLICATIONS

International Search Report, PCT/CN2012/080061, Nov. 22, 2012.

*Primary Examiner* — Steven B McAllister
*Assistant Examiner* — Ko-Wei Lin
(74) *Attorney, Agent, or Firm* — Matthew A. Pequignot; Pequignot + Myers LLC

(57) ABSTRACT

An indoor air-conditioner unit comprises an air duct, an air outlet connected with the air duct, and an air deflector guiding directions of air flow from the air-conditioner. A volute tongue is provided in the air duct and near an outer end of the air outlet. Wherein, the indoor air-conditioner unit further comprises a central support mechanism, which is elastically arranged between the central part of the back of the air deflector and the volute tongue, thus a complete seal of the air outlet can be achieved when the air deflector is closed, i.e., there are no gaps in the air outlet.

11 Claims, 6 Drawing Sheets

(56) References Cited

FOREIGN PATENT DOCUMENTS

| | | | | |
|---|---|---|---|---|
| JP | 11-270896 | | 10/1999 | |
| JP | WO 2011007520 | A1 * | 1/2011 | ..... F24F 1/0011 |

* cited by examiner

INDOOR AIR-CONDITIONER UNIT WITH AIR DEFLECTOR

RELATED APPLICATION DATA

This application is the national stage entry of International Appl. No. PCT/CN2012/080061, filed Aug. 13, 2012, which claims priority to Chinese Patent Application No. CN 201110233898.3, filed Aug. 16, 2011. All claims of priority to these applications are hereby made, and each of these applications is hereby incorporated in its entirety by reference.

TECHNICAL FIELD

The present invention belongs to the technical field of the structure of air-conditioner, and more particularly, relates to an indoor air-conditioner unit.

BACKGROUND OF THE INVENTION

In the prior art, the indoor air-conditioner unit is provided with an air deflector to guide the directions of the upward air flow and downward air flow from the air-conditioner. In the design of the air deflector, a driving motor is fixed on the bottom case; the axis of the air deflector remains at the same position when the deflector rotates. As gaps between the air deflector and the periphery of the air outlet should be left for the rotation of the air deflector, when the air-conditioner stops working and the air deflector is completely closed, gaps between the air deflector and the periphery of the air outlet still exist (at the left, at the right, at the top and at the bottom), which affect the appearance of the air-conditioner. What's more, the movement contrail of the air deflector is simple, that is, the air deflector just rotates around the fixed shaft, thereby multi-angle air supply cannot be achieved. Meanwhile, as the air outlet is not sealed completely, dust, virus and so on will go inside the air-conditioner indoor unit with air deflector, which will affect the cleanliness of air indoors.

SUMMARY OF THE INVENTION

The present disclosure aims at providing an indoor air-conditioner unit, which can achieve a complete seal of the air outlet with no gap at the air outlet when the air deflector is closed.

The present disclosure is realized by the following technical scheme:

An indoor air-conditioner unit, comprising an air duct, an air outlet communicated with the air duct, and an air deflector guiding directions of air flow from the air-conditioner; wherein, a volute tongue is provided at an outer end of the air duct near the air outlet; and the indoor air-conditioner unit further comprises a central supporting mechanism, which is retractably disposed between a central part of a back of the air deflector and the volute tongue.

Preferably, the central supporting mechanism comprises multiple foldable connecting rods; the multiple foldable connecting rods comprise a first rod, a second rod and a seat fixed on a central part of the volute tongue; a seat sliding groove is disposed in an inner cavity of the seat; an inner end of the first rod is disposed to reciprocate along the seat sliding groove in the inner cavity of the seat; a rod sliding groove is disposed in an inner cavity of the first rod, and an inner end of the second rod is disposed to reciprocate along the rod sliding groove in the inner cavity of the first rod; and an outer end of the second rod is hinged with a mid supporting rib, which is provided at the central part of the back of the air deflector.

Preferably, the indoor air-conditioner unit further comprises an open-close mechanism of air deflector, which is connected with and drives the air deflector; and the air deflector is rotatably disposed at an outer side of the air outlet.

Preferably, the open-close mechanism of air deflector comprises a left ejecting device disposed on a left supporting end of the air deflector and a right ejecting device disposed on a right supporting end of the air deflector; a first end of the left ejecting device and a first end of the right ejecting device are respectively fixed on a body of the air-conditioner; and a second end of the left ejecting device and a second end of the right ejecting device are respectively connected with the back of the air deflector and drive the air deflector.

Preferably, the left ejecting device comprises a first driving motor, a left gear wheel, which is connected to and driven by the first driving motor, and a left rack connecting rod, which engages with the left gear wheel; and the left rack connecting rod is connected to and drives the air deflector.

Preferably, the left ejecting device further comprises a left box; the first driving motor is fixed at an outer side of the left box; an output shaft of the first driving motor goes through a side wall of the left box to connect with and drive the left gear wheel; an inner end of the left rack connecting rod is disposed to reciprocate in an inner cavity of the left box; an outer end of the left rack connecting rod extends through the left box to connect with and drive the left supporting end of the air deflector.

Preferably, the left ejecting device further comprises a rotation driving motor, which is fixedly connected to the left rack connecting rod; and the rotation driving motor is fixed on the left supporting end of the air deflector.

Preferably, the rotation driving motor is disposed on the second end of the left ejecting device; a rib is provided on a side of the left supporting end of the air deflector, said side faces the air outlet; the rib has a motor mounting hole which engages with an output shaft of the rotation driving motor; and the output shaft of the rotation driving motor is directly inserted into the motor mounting hole of the rib.

Preferably, the right ejecting device comprises a second driving motor, a right gear wheel which is connected to and driven by the second driving motor, and a right rack connecting rod which is connected to and engages with the right gear wheel.

Preferably, the right ejecting device further comprises a right box; the second driving motor is fixed at an outer side of the right box; an output shaft of the second driving motor goes through a side wall of the right box to connected with and drive the right gear wheel; an inner end of the right rack connecting rod is disposed to reciprocate in an inner cavity of the right box; and an outer end of the right rack connecting rod extends through the right box to connect with and drive the right supporting end of the air deflector.

Preferably, the left rack connecting rod or the right rack connecting rod is straight or curved in shape; the left box comprises an upper left fixing box and a lower left fixing box, which are buckled together; a second end of the left box has a first opening; the outer end of the left rack connecting rod goes through the first opening; a first end of the left box is fixed on the body of the air-conditioner; the right box comprises an upper right fixing box and a lower right fixing box, which are buckled together; the second end of the right box has a second opening; the outer end of the right rack connecting rod goes through the second opening; and a first end of the right box is fixed on the body of the air-conditioner.

Preferably, a right connecting end is provided on a right end of the back of the air deflector, the right connecting end is a rib; the right connecting end is provided with a mounting hole for rack connecting rod; the outer end of the right rack connecting rod is provided with a pin shaft which engages with the mounting hole for rack connecting rod; the mounting hole for rack connecting rod has a notch which engages with an outer wall of the pin shaft; and a mushroom-shaped protuberance is provided at an end of the pin shaft to avoid the pin shaft releasing from the right connecting end.

Preferably, a right connecting end is provided on a right end of the back of the air deflector, the right connecting end is a rib; the right connecting end is provided with a mounting hole for rack connecting rod; the outer end of the right rack connecting rod is provided with a pin shaft which engages with the mounting hole for rack connecting rod; the mounting hole for rack connecting rod has a notch which engages with an outer wall of the pin shaft; and a limit protuberance is provided at an end of the pin shaft to avoid the pin shaft releasing from the right connecting end.

Preferably, when the air deflector is closed, volume of the left ejecting device and the right ejecting device, which is below a horizontal central line of the air outlet, is larger than volume of the left ejecting device and the right ejecting device, which is above the horizontal central line of the air outlet.

Preferably, the left ejecting device and the right ejecting device are fixed on side walls of the body of the air-conditioner.

The present disclosure has the following advantages:

According to the indoor air-conditioner unit of the present disclosure, as the open-close mechanism of air deflector is provided and the air deflector is rotatably disposed at the outer side of the air outlet, when the air deflector is rotating, the whole rotating space of the air deflector is located outside the air outlet. When the air-conditioner stops running, the air deflector covers the outer end of the air outlet, and the area covered by the air deflector is larger than or equal to the area of the outer end of the air outlet. When the air deflector is closed, the air deflector perfectly fits the panel body with no gap therebetween. When the air deflector is opened, the left ejecting device and the right ejecting device eject out the air deflector, and at the same time, the rotation driving motor operates to drive the air deflector to rotate. The ejecting distance of the air deflector is controlled through controlling the motor of the left ejecting device and the motor of the right ejecting device. The rotation angle of the air deflector is controlled through controlling the rotation driving motors. The central support mechanism, which is not driven by any motor, is fixed on the body of the air-conditioner to support and guide the air deflector, and further to prevent the air deflector from deforming or swaying during rotation.

Through simple assembly, the indoor air-conditioner unit of the present disclosure can achieve a complete seal with no gap between the air deflector and the air outlet when the air deflector is closed. The air deflector can rotate with multiple angles and can have a complicated movement contrail, enabling several manners of air blowing, which meets the comfort demand of users, and can become one of the highlights and advantages of the product, thereby making the product competitive in the market.

Figure 1:
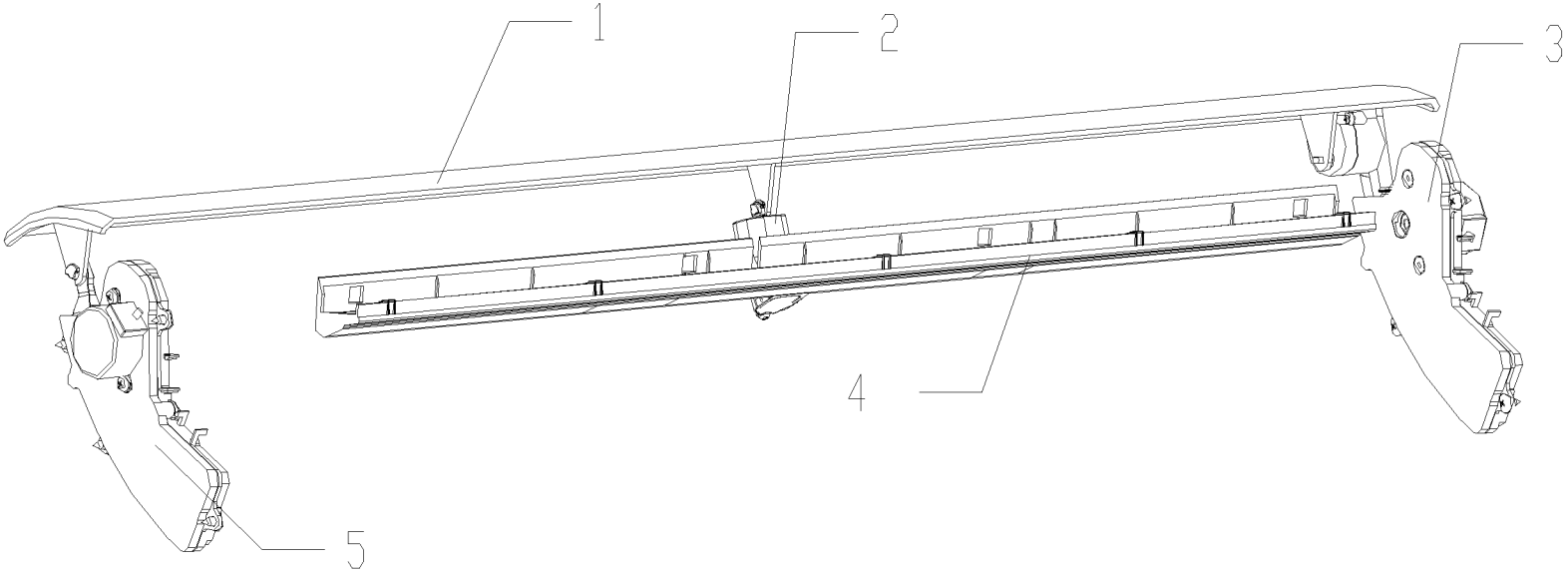
FIG. 1 is a whole assembly diagram of the air deflector of indoor air-conditioner unit and the open-close mechanism of air deflector according to the present disclosure.
Figure 2:
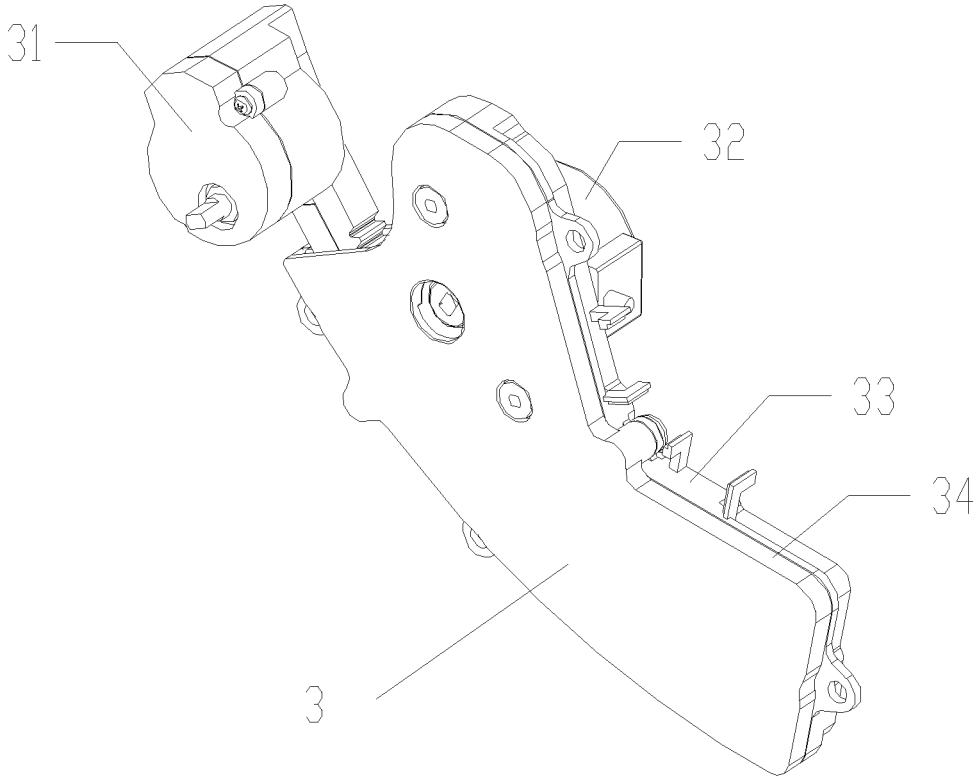
FIG. 2 is a whole structural diagram of the left ejecting device of indoor air-conditioner unit according to the present disclosure.
Figure 3:
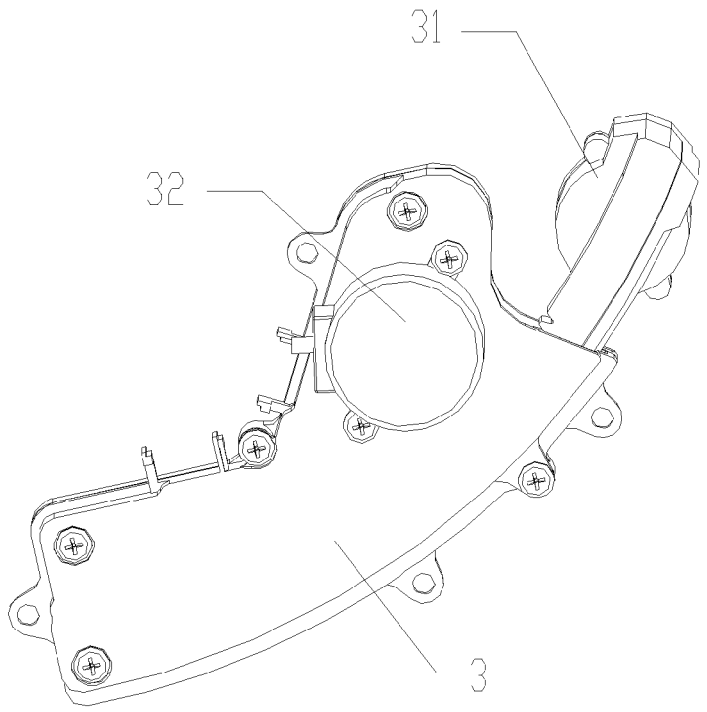
FIG. 3 is a schematic view illustrating the position and structure of the rotation driving motor of indoor air-conditioner unit according to the present disclosure.
Figure 4:
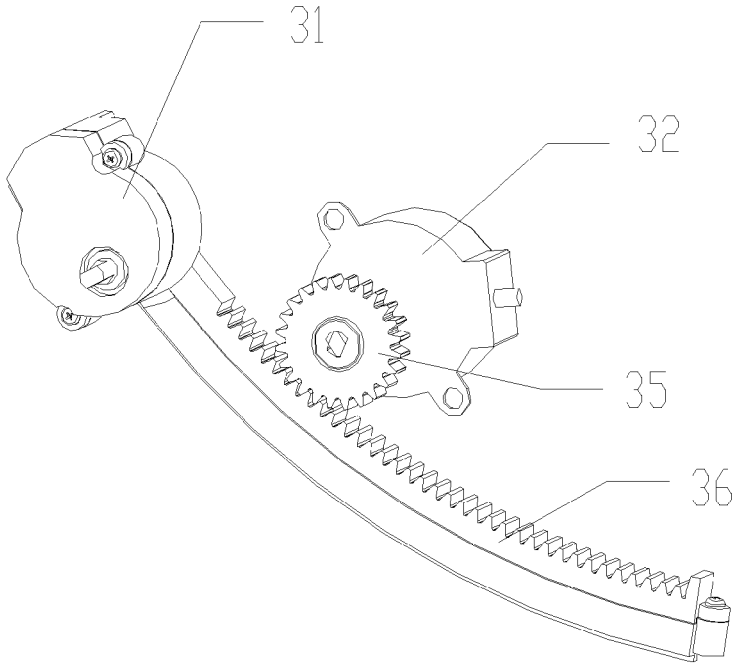
FIG. 4 is a schematic view illustrating the internal structure of the left ejecting device according to the present disclosure.
Figure 5:
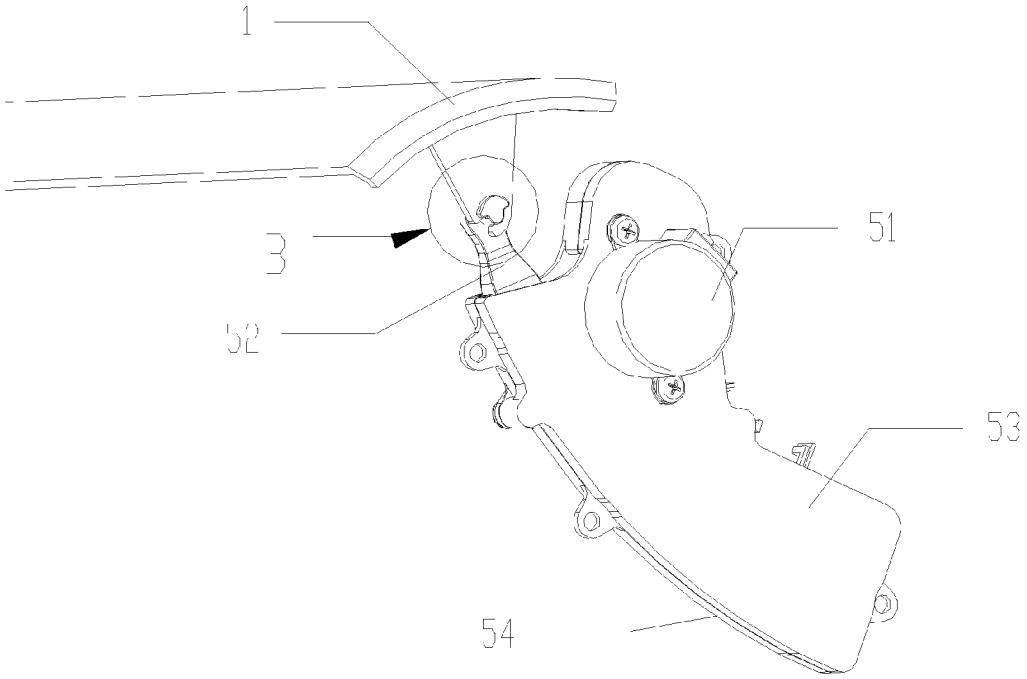
FIG. 5 is a whole structural diagram of the right ejecting device of indoor air-conditioner unit according to the present disclosure.
Figure 6:
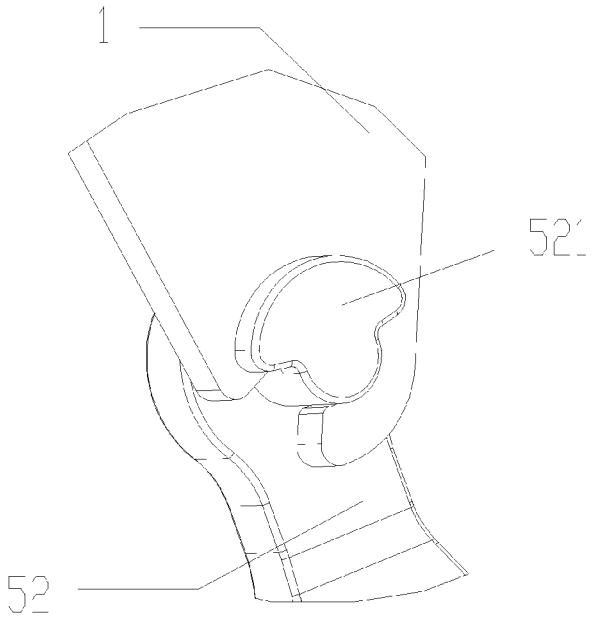
FIG. 6 is a partially enlarged view illustrating a first connecting structure between the right ejecting device and the air deflector according to the present disclosure.
Figure 7:
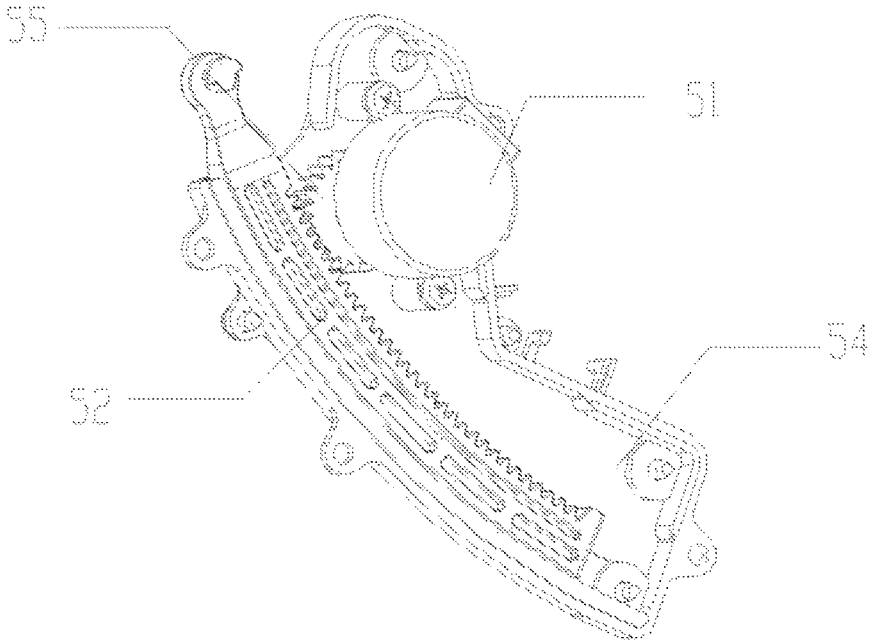
FIG. 7 is a schematic view illustrating the internal structure of the right ejecting device according to the present disclosure.
Figure 8:
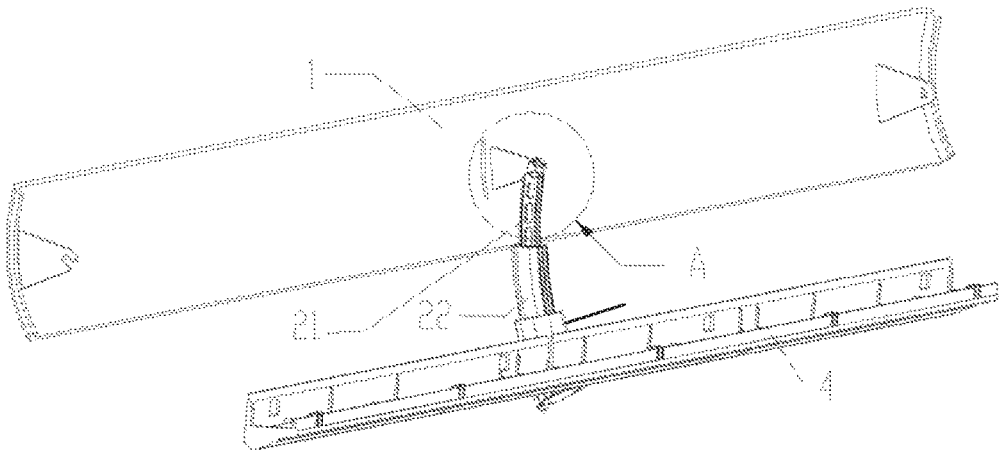
FIG. 8 is a whole structural diagram illustrating the central supporting mechanism of indoor air-conditioner unit when it is in the state of being stretched according to the present disclosure.
Figure 9:
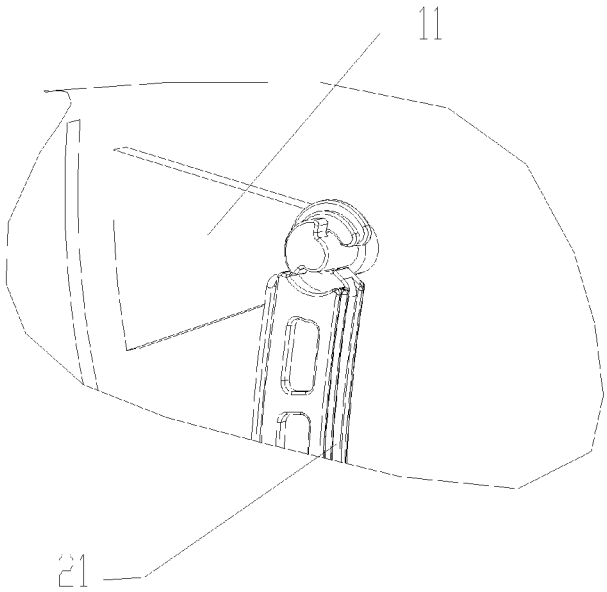
FIG. 9 is a partially enlarged view illustrating a second connecting structure between the central supporting mechanism and the air deflector according to the present disclosure.
Figure 10:
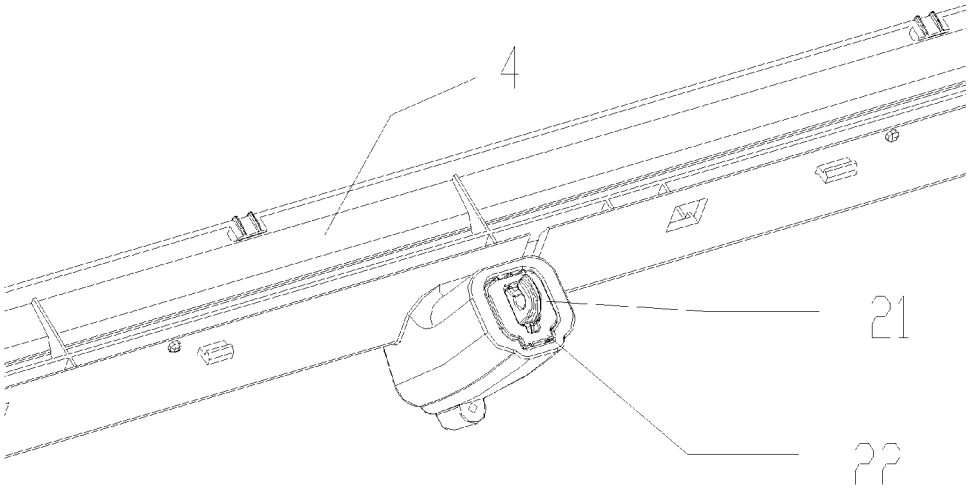
FIG. 10 is a whole structural diagram illustrating the central supporting mechanism when it is in the state of being retracted according to the present disclosure.

The elements are denoted as follows:

| | | |
|---|---|---|
| 1. air deflector, | 2. central supporting mechanism, | 3. left ejecting device, |
| 4. volute tongue, | 5. right ejecting device, | 11. mid supporting rib, |
| 21. second rod, | 22. first rod, | 31. rotation driving motor, |
| 32. first driving motor, | 33. upper left fixing box, | 34. lower left fixing box, |
| 35. left gear wheel, | 36. left rack connecting rod, | 51. second driving motor, |
| 52. right rack connecting rod, | 53. upper right fixing box, | 54. lower right fixing box, |
| 55. right gear wheel, | 521. pin shaft. | |

DETAILED DESCRIPTION OF THE PREFERRED EMBODIMENTS

The present invention discloses an indoor air-conditioner unit. As shown in FIGS. 1, 8, 9, and 10, the indoor air-conditioner unit comprises an air duct, an air outlet communicated with the air duct, and an air deflector 1 guiding directions of air flow from the air-conditioner. A volute tongue 4 is provided at the outer end of the air duct near the air outlet. The indoor air-conditioner unit further comprises a central supporting mechanism 2, which is retractably disposed between the central part of the back of the air deflector 1 and the volute tongue 4. The length of the central supporting mechanism 2 can be changed along with the movement of the air deflector 1. One end of the central supporting mechanism 2 is fixed in the body of the air-conditioner, the other end of the central supporting mechanism 2 is connected to the central part of the back of the air deflector 1. The back of the air deflector 1 herein refers to the side of the air deflector, which faces the air outlet.

The central supporting mechanism 2 includes multiple extendable connecting rods. The multiple extendable connecting rods herein comprise a plurality of connecting rods which can move relatively to each other, and a connecting mechanism which is a seat for mounting the connecting rods. Specifically, according to the first embodiment, the multiple extendable connecting rods comprise a first rod 22, a second rod 21 and a seat 6 fixed with the central part of the volute tongue 4. A seat sliding groove is provided in the inner cavity of the seat 6. The inner end of the first rod 22 is disposed in the inner cavity of the seat 6 and can reciprocate along the seat sliding groove. A rod sliding groove is provided in the inner cavity of the first rod 22, and the inner end of the second rod 21 is disposed in the inner cavity of the first rod 22 and can reciprocate along the rod sliding groove. By means of shaft-hole connection, the outer end of the second rod 21 is connected to a mid supporting rib 11, which is provided at the central part of the back of the air deflector 1. Specifically, the shaft-hole connection is embodied as a hinge joint.

The indoor air-conditioner unit, as shown in FIG. 1, comprises the air duct, the air outlet communicated with the air duct, and the air deflector 1 guiding the directions of air flow from the air-conditioner. The volute tongue 4 is provided at the outer end of the air duct near the air outlet. The indoor air-conditioner unit further comprises an open-close mechanism of air deflector, which is connected with and drives the air deflector 1. When the air-conditioner operates, the open-close mechanism of air deflector can drive the axle of the air deflector 1 to deviate outwards from the region of the air outlet. The air deflector 1 is rotatably disposed at an outer side of the air outlet. When the air deflector 1 is rotating, the whole rotating space of the air deflector 1 is located outside the air outlet. When the air-conditioner stops running, the air deflector 1 covers the outer end of the air outlet.

The open-close mechanism of air deflector comprises a left ejecting device 3 disposed at the left supporting end of the air deflector 1 and a right ejecting device 5 disposed at the right supporting end of the air deflector 1. The first end of the left ejecting device 3 and the first end of the right ejecting device 5 are respectively fixed on the body of the air-conditioner. The second end of the left ejecting device and the second end of the right ejecting device are respectively connected with the back of the air deflector 1 and drive the air deflector 1.

As shown in FIGS. 1, 2, 3 and 4, the left ejecting device 3 comprises a first driving motor 32, a left gear wheel 35 which is connected to and driven by the first driving motor 32, a left rack connecting rod 36 which engages with the left gear wheel 35, and a left box. The left gear wheel 35 is fixed on the output shaft of the first driving motor 32. The first driving motor 32 is fixed at an outer side of the left box. The left gear wheel 35 is disposed in the inner cavity of the left box. The output shaft of the first driving motor 32 goes through the side wall of the left box to connect with and drive the left gear wheel 35. The inner end of the left rack connecting rod 36 can reciprocate in the inner cavity of the left box. The outer end of the left rack connecting rod 36 extends through the left box to connect with and drive the left supporting end of the air deflector 1.

The left ejecting device 3 further comprises a rotation driving motor 31, which is fixedly connected to the left rack connecting rod 36. The output shaft of the rotation driving motor 31 is directly fixed on the left supporting end of the air deflector 1.

The rotation driving motor 31 is disposed at the second end of the left ejecting device 3. The left supporting end of the air deflector 1 is a rib disposed at the left side of the back of the air deflector 1. The rib has a motor mounting hole which engages with the output shaft of the rotation driving motor 31. The output shaft of the rotation driving motor 31 is directly inserted into the motor mounting hole of the rib.

As shown in FIGS. 1, 5, 6 and 7, the right ejecting device 5 comprises a second driving motor 51, a right gear wheel 55 which is connected to and driven by the second driving motor 51, a right rack connecting rod 52 which engages with the right gear wheel 55, and a right box. The right gear wheel 55 is fixed on the output shaft of the second driving motor 51. The second driving motor 51 is fixed at an outer side of the right box. The right gear wheel 55 is disposed in the inner cavity of the right box. The output shaft of the second driving motor 51 goes through the side wall of the right box to connect with and to drive the right gear wheel 55. The inner end of the right rack connecting rod 52 can reciprocate in the inner cavity of the right box. The outer end of the right rack connecting rod 52 extends through the right box to connect with and drive the right supporting end of the air deflector 1.

The left rack connecting rod 36 or the right rack connecting rod 52 is straight or curved in shape. The left box comprises an upper left fixing box 33 and a lower left fixing box 34, which are buckled together. The second end of the left box has a first opening, and the outer end of the left rack connecting rod 36 goes through the first opening. The first end of the left box is fixed on the body of the air-conditioner. The right box comprises an upper right fixing box 53 and a lower right fixing box 54, which are buckled together. The second end of the right box has a second opening, and the outer end of the right rack connecting rod 52 goes through the second opening. The first end of the right box is fixed on the body of the air-conditioner.

A right connecting end is provided on the right end of the back of the air deflector 1. The right connecting end is a rib, which is provided with a mounting hole for rack connecting rod. The outer end of the right rack connecting rod 52 is provided with a pin shaft 521 which engages with the mounting hole for rack connecting rod. The mounting hole for rack connecting rod has a notch which engages with the outer wall of the pin shaft 521, in order that the pin shaft 521 can go in and go out through the notch conveniently. A mushroom-shaped protuberance or a limit protuberance is provided at the end of the pin shaft 521 to avoid the pin shaft 521 releasing from the right connecting end.

In order to make the internal structure of the air-conditioner more compact so as to improve the space utilization, when the air deflector 1 is closed, the volume of the left ejecting device 3 and the right ejecting device 5, which is below the horizontal central line of the air outlet, is larger than that above the horizontal central line of the air outlet. The left ejecting device 3 and the right ejecting device 5 are fixed on side walls of the body of the air-conditioner.

If the indoor air-conditioner unit of the present disclosure would achieve the effect that there is no gap between the air deflector and the periphery (the left end, the right end, the upper end and the lower end) of the air outlet, when the air deflector rotates, the air deflector shall adopt the manner that the axle of the air deflector deviates from the air outlet. By this means, when the air deflector is rotating, the whole rotating space of the air deflector is located outside the air outlet, and the air deflector and the air outlet will be completely staggered and the air deflector will move without interfering with the air outlet. In the present disclosure, the open-close mechanism of air deflector is provided at the left and the right side of the panel body. The motor drives the gear wheel to rotate and the gear wheel drives the rack connecting rod to move, so as to further drive the open-close mechanism of air deflector. The left rack connecting rod and the right rack connecting rod may be different in structure, one of them can be provided with a motor. The volute tongue is provided with the central supporting mechanism, which can be stretched and retracted through multiple foldable connecting rods. The central supporting mechanism has the functions of supporting and directing, and can prevent the air deflector from deforming.

The preferred embodiments of the present invention described above are not intended to limit the present disclosure. It will be understood by those skilled in the art that any improvements and variations can be made without departing from the scope of the disclosure as defined in the accompanying claims.

What is claimed is:

1. An indoor air-conditioner unit, comprising an air duct, an air outlet communicated with the air duct, an air deflector guiding directions of air flow from the air-conditioner, an open-close mechanism of the air deflector;

a volute tongue provided at an outer end of the air duct near the air outlet; and a central supporting mechanism, which is retractably disposed between a central part of a back of the air deflector and the volute tongue;

wherein said open-close mechanism is connected with and drives the air deflector;

wherein the air deflector is rotatably disposed at an outer side of the air outlet;

wherein the open-close mechanism comprises:

a left ejecting device disposed on a left supporting end of the air deflector and a right ejecting device disposed on a right supporting end of the air deflector;

a first end of the left ejecting device and a first end of the right ejecting device are respectively fixed on a body of the air-conditioner; and a second end of the left ejecting device and a second end of the right ejecting device are respectively connected with the back of the air deflector and drive the air deflector;

wherein the left ejecting device comprises:

a first driving motor, a left gear wheel, which is connected to and driven by the first driving motor, and a left rack connecting rod, which engages with the left gear wheel; and is connected to and drives the air deflector; and a left box;

wherein the first driving motor is fixed at an outer side of the left box;

wherein an output shaft of the first driving motor goes through a side wall of the left box to connect with and drive the left gear wheel;

wherein an inner end of the left rack connecting rod is disposed to reciprocate in an inner cavity of the left box;

wherein an outer end of the left rack connecting rod extends through the left box to connect with and drive the left supporting end of the air deflector.

2. The indoor air-conditioner unit according to claim 1, wherein, the central supporting mechanism comprises multiple extendable connecting rods;

wherein the multiple extendable connecting rods comprise a first rod, a second rod and a seat fixed on a central part of the volute tongue;

wherein a seat sliding groove is disposed in an inner cavity of the seat;

wherein an inner end of the first rod is disposed to reciprocate along the seat sliding groove in the inner cavity of the seat;

wherein a rod sliding groove is disposed in an inner cavity of the first rod, and an inner end of the second rod is disposed to reciprocate along the rod sliding groove in the inner cavity of the first rod; and wherein an outer end of the second rod is hinged with a mid supporting rib, which is provided at the central part of the back of the air deflector.

3. The indoor air-conditioner unit according to claim 1, wherein, the left ejecting device further comprises a rotation driving motor, which is fixedly connected to the left rack connecting rod; and wherein the rotation driving motor is fixed on the left supporting end of the air deflector.

4. The indoor air-conditioner unit according to claim 3, wherein, the rotation driving motor is disposed on the second end of the left ejecting device;

wherein a rib is provided on a side of the left supporting end of the air deflector, said side faces the air outlet;

wherein the rib has a motor mounting hole which engages with an output shaft of the rotation driving motor; and wherein the output shaft of the rotation driving motor is directly inserted into the motor mounting hole of the rib.

5. The indoor air-conditioner unit according to claim 1, wherein, the right ejecting device comprises:

a second driving motor, a right gear wheel, which is connected to and driven by the second driving motor, and a right rack connecting rod which is connected to and engages with the right gear wheel.

6. The indoor air-conditioner unit according to claim 5, wherein, the right ejecting device further comprises a right box;

wherein the second driving motor is fixed at an outer side of the right box;

wherein an output shaft of the second driving motor goes through a side wall of the right box to connect with and drive the right gear wheel;

wherein an inner end of the right rack connecting rod is disposed to reciprocate in an inner cavity of the right box; and wherein an outer end of the right rack connecting rod extends through the right box to connect with and drive the right supporting end of the air deflector.

7. The indoor air-conditioner unit according to claim 6, wherein, the left rack connecting rod or the right rack connecting rod is curved in shape;

wherein the left box comprises an upper left fixing box and a lower left fixing box, which are buckled together;

wherein a second end of the left box has a first opening;

wherein the outer end of the left rack connecting rod goes through the first opening;

wherein a first end of the left box is fixed on the body of the air-conditioner;

wherein the right box comprises an upper right fixing box and a lower right fixing box, which are buckled together;

wherein the second end of the right box has a second opening;

wherein the outer end of the right rack connecting rod goes through the second opening; and wherein a first end of the right box is fixed on the body of the air-conditioner.

8. The indoor air-conditioner unit according to claim 7, wherein, a right connecting end is provided on a right end of the back of the air deflector, wherein the right connecting end is a rib;

wherein the right connecting end is provided with a mounting hole for rack connecting rod;

wherein the outer end of the right rack connecting rod is provided with a pin shaft which engages with the mounting hole for rack connecting rod;

wherein the mounting hole for rack connecting rod has a notch which engages with an outer wall of the pin shaft; and wherein a mushroom-shaped protuberance is provided at an end of the pin shaft to avoid the pin shaft releasing from the right connecting end.

9. The indoor air-conditioner unit according to claim 7, wherein, a right connecting end is provided on a right end of the back of the air deflector, wherein the right connecting end is a rib;

wherein the right connecting end is provided with a mounting hole for rack connecting rod;

wherein the outer end of the right rack connecting rod is provided with a pin shaft which engages with the mounting hole for rack connecting rod;

wherein the mounting hole for rack connecting rod has a notch which engages with an outer wall of the pin shaft; and wherein a limit protuberance is provided at an end of the pin shaft to avoid the pin shaft releasing from the right connecting end.

10. The indoor air-conditioner unit according to claim 8, wherein, when the air deflector is closed, a first volume of a first part of the left ejecting device and the right ejecting device, which is below a horizontal central line of the air outlet, is larger than a second volume of a second part of the left ejecting device and the right ejecting device, which is above the horizontal central line of the air outlet.

11. The indoor air-conditioner unit according to claim 8, wherein, the left ejecting device and the right ejecting device are fixed on side walls of the body of the air-conditioner.

* * * * *